US006860714B1

(12) United States Patent
McNulty et al.

(10) Patent No.: US 6,860,714 B1
(45) Date of Patent: Mar. 1, 2005

(54) GAS TURBINE HAVING ALLOY CASTINGS WITH CRAZE-FREE COOLING PASSAGES

(75) Inventors: Thomas Francis McNulty, Ballston Lake, NY (US); Frederic Joseph Klug, Schenectady, NY (US); Shyh-Chin Huang, Latham, NY (US); Michael Francis Xavier Gigliotti, Jr., Scotia, NY (US)

(73) Assignee: General Electric Company, Niskayuna, NY (US)

( * ) Notice: Subject to any disclaimer, the term of this patent is extended or adjusted under 35 U.S.C. 154(b) by 27 days.

(21) Appl. No.: 10/334,120

(22) Filed: Dec. 30, 2002

(51) Int. Cl.[7] ..... F01D 5/08

(52) U.S. Cl. ..... 415/115; 415/200; 416/241 R; 416/241 B; 416/96 R; 264/225

(58) Field of Search ..... 416/223 R, 241 R, 416/241 B, 96 R, 90 R, 96 A, 97 R; 415/115, 200; 264/109, 219, 220, 221, 222, 223, 224, 225, 226, 227

(56) References Cited

U.S. PATENT DOCUMENTS

| | | | | |
|---|---|---|---|---|
| 4,894,194 A | | 1/1990 | Janney | 265/109 |
| 5,028,362 A | | 7/1991 | Janney et al. | 264/25 |
| 5,145,908 A | * | 9/1992 | Jenny et al. | 524/827 |
| 6,066,279 A | | 5/2000 | Walls et al. | 264/119 |
| 6,192,688 B1 | | 2/2001 | Beebe | 60/723 |
| 6,228,299 B1 | | 5/2001 | Janney et al. | 264/118 |
| 6,365,082 B1 | | 4/2002 | Walls et al. | 265/219 |
| 6,464,462 B2 | * | 10/2002 | Stathopoulos et al. | 416/96 R |
| 2001/0003576 A1 | | 6/2001 | Klett et al. | 423/445 |

OTHER PUBLICATIONS

Optimal Composition of Zircon–Fused Silica Ceramic Cores for Casting Superalloys; Chao et al.; J. Am Ceram. Soc., 85 [4] 773–79 (2003).

Turbine Renewal: Shaping an Emerging Gas–Fired Power Source; ORNL Review vol. 33, No. 1, 2000.

* cited by examiner

*Primary Examiner*—F. Daniel Lopez
*Assistant Examiner*—Dwayne White
(74) *Attorney, Agent, or Firm*—Paul J. DiConza; Patrick K. Patnode

(57) ABSTRACT

An airfoil for an internal combustion engine, such as a gas turbine, formed by use of a preform. The airfoil includes: an outer surface forming the foil shape; and a plurality of craze-free cooling passages extending through the airfoil. In the preferred embodiment, a root on the airfoil joins the airfoil to the hub of a gas turbine vane assembly. Also, in the preferred embodiment, the gas turbine vane assembly is adapted to receive replaceable airfoils.

14 Claims, 5 Drawing Sheets a)

b)

GAS TURBINE HAVING ALLOY CASTINGS WITH CRAZE-FREE COOLING PASSAGES

BACKGROUND OF INVENTION

The present invention relates generally to airfoils for internal combustion engines, such as gas turbines, and more particularly to gas-turbine castings using ceramic cores with a smooth, craze-free surface for improving the surfaces within the cooling passages of the metal casting.

According to the Department of Energy, natural gas turbines are expected to make up more than 80% of the power-generating capacity to be added in the United States over the next 10 to 15 years. Of the more than 200 new power plant projects announced recently in the United States, 96% plan to use natural gas and most will employ gas turbines.

A turbine is a rotary engine that uses a continuous stream of fluid to turn a shaft that drives machinery, such as the rotor of an electric generator. A gas turbine generally consists of a compressor, combustor, and turbine. Part of the turbine drives the compressor, which draws in large quantities of air, compresses it, and feeds the high-pressure air into the combustor. There the air is mixed with a fuel, such as natural gas, kerosene, or gas derived from coal. The mixture is burned, providing high-pressure gases to drive the turbine. Conventional land-based gas turbines used for power generation are 33 to 40% efficient when used in "simple cycle" mode-that is, without a recuperator or steam generator. Because of the high temperatures in the turbine, most of the airfoils include internal cooling channels, formed by casting.

In a typical airfoil metal casting process, ceramic cores, generally silica-based, are used to produce cooling passages in the airfoil metal casting. Silica cores used for gas turbine applications have complex geometries with large variations in cross-section thickness. Current cores are prepared by using an alcohol-based, gel-casting process.

The current process requires that the cores are dried prior to die injection. In order to achieve acceptable projection rates, a proprietary drying technique is employed. Due to the differential drying shrinkage between the surface and the bulk of the core, the surfaces tend to crack, yielding a crazed surface finish. After subsequent firing, the metal is cast around the ceramic core, and then the ceramic core is leached out using a strong acid. However, the crazed surface finish has been transferred to the metal. By casting with cores that have a smooth surface finish, the quality of the cooling passages, in addition to the mechanical integrity, should be vastly improved.

Conventional silica low-pressure core fabrication provides adequate die release and elimination of surface defects. However, since current silica core technology is based on alcohol containing slurries, for environmental and EHS considerations it is desirable to have a water-based system.

Another property of a good casting system is the type of porosity created when the part is formed since more closed porosity limits the binder removal rate. For example, slip casting and gel casting both produce open continuous porosity prior to binder removal. However, slip cast parts may take up to a week to dry sufficiently to be handled because the parts dry by capillary action. In addition, slip cast parts are difficult to produce having the tolerances required for gas turbine applications.

Water-based, gel casting is a recently developed technique pioneered by Janney et al. of Oak Ridge National Laboratories. U.S. Pat. Nos. 4,894,194 (issued Jan. 16, 1990); 5,028,362 (issued Jul. 2, 1991); 6,066,279 (issued May 23, 2000); 6,228,229 (issued May 8, 2001); 6,365,082 (issued Apr. 2, 2002) and Patent Application Publication U.S. 2001/0003576 (published Jun. 14, 2001) disclose various aspects to producing water-based, gels and castings. The disclosures of which are hereby incorporated by reference in their entirety.

Water-based, gel casting offers the best potential for mechanical properties and viscosity. In addition, water-based, gel casting offers the advantages of material dispersion, die release and dimensional reproducibility. Finally, ceramic cores prepared using water-based, gel casting can be dried using more conventional drying techniques such as controlled-humidity drying or freeze-drying.

Thus, there remains a need for a method to produce gas-turbine alloy castings having craze-free cooling passages which sets up much more quickly than slip casting while, at the same time, avoids the binder burn-off cracking problem associated with current injection molded, alcohol-based binder systems.

SUMMARY OF INVENTION

The present invention is directed to an airfoil for an internal combustion engine, such as a gas turbine, formed by use of a preform. The airfoil includes: an outer surface forming the foil shape; and a plurality of craze-free cooling passages extending through the airfoil. In the preferred embodiment, a root on the airfoil joins the airfoil to the hub of a gas turbine vane assembly. Also, in the preferred embodiment, the gas turbine vane assembly is adapted to receive replaceable airfoils.

According to the present invention, the craze-free cooling passages are formed by use of a ceramic preform. In the preferred embodiment, the preform includes: (i) ceramic powder; and (ii) a water-based, gel forming precursor.

The ceramic powder maybe a silica-based ceramic. In the preferred embodiment, the silica-based ceramic is a silica zirconium ceramic having a particle size distribution between about 0.05 and 25 microns.

Also, in the preferred embodiment, the water-based, gel forming precursor is a monomer solution including at least one water based, monofunctional monomer and at least one water-based, difunctional monomer, the functional group of the monofunctional and difunctional monomer selected from vinyl and allyl groups, a free radical initiator compound and an aqueous solvent.

The preform may further include a dispersant for dispersing the ceramic powder. In the preferred embodiment, the dispersant is tetramethyl ammonium hydroxide. Also, in the preferred embodiment, the pH of the dispersant for dispersing the ceramic powder is adjusted to between 10.5 and 11.5.

The gas turbine vane assembly may be a rotating assembly. Preferably, the rotating assembly is attached to the shaft of a gas turbine. The gas turbine vane assembly may also be a stationary assembly. Preferably, the stationary assembly is attached to the shell of a gas turbine.

Accordingly, one aspect of the present invention is to provide an airfoil for an external combustion engine, such as a gas turbine, formed by use of a preform, the airfoil including: an outer surface forming the foil shape; a plurality of craze-free cooling passages extending through the airfoil; and a root for joining the airfoil to the hub of a gas turbine vane assembly.

Another aspect of the present invention is to provide a ceramic preform for forming an airfoil having a plurality of craze-free cooling passages, the preform including: ceramic powder; and a water-based, gel forming precursor.

Still another aspect of the present invention is to provide an airfoil for an external combustion engine, such as a gas turbine, formed by use of a preform, the airfoil including: an outer surface forming the foil shape; a plurality of craze-free cooling passages extending through the airfoil, the craze-free cooling passages being formed by use of a ceramic preform for forming the airfoil, the preform including: (i) ceramic powder; and (ii) a water-based, gel forming precursor; and a root for joining the airfoil to the hub of a gas turbine vane assembly, wherein the gas turbine vane assembly is adapted to receive replaceable airfoils.

These and other aspects of the present invention will become apparent to those skilled in the art after a reading of the following description of the preferred embodiment when considered with the drawings.

DETAILED DESCRIPTION

Figure 1:
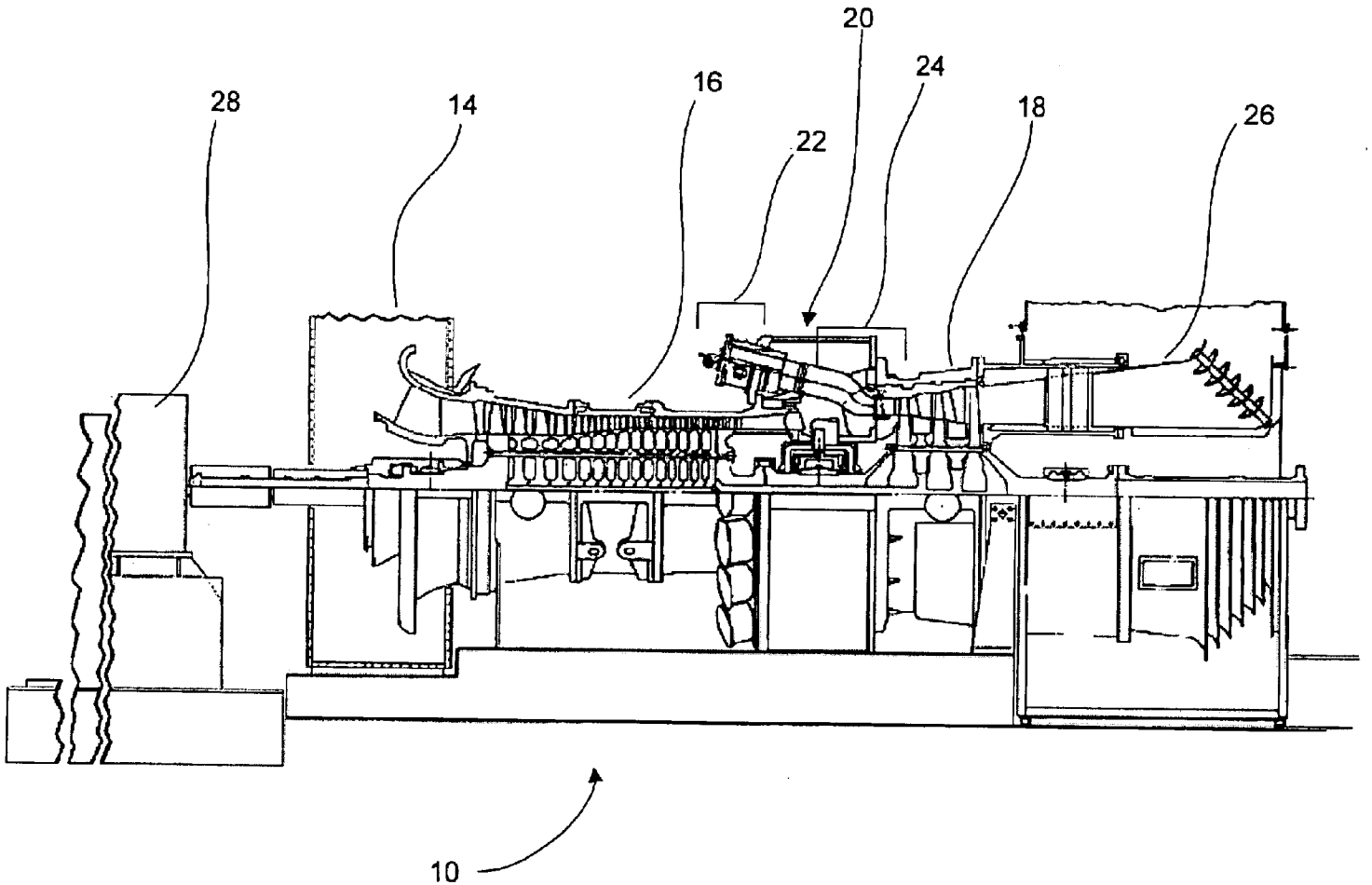
FIG. 1 is a perspective view of an internal combustion engine, such as a gas turbine, having improved airfoils constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to drawings in general and FIG. 1 in particular, it will be understood that the illustrations are for the purpose of describing a preferred embodiment of the invention and are not intended to limit the invention thereto. As best seen in FIG. 1, a turbine, generally designated 10, is shown including a combustion section 20 having a primary combustion system 22 and a secondary combustion system 24 including an injector for transversely injecting a secondary fuel mixture into a stream of combustion products of the primary combustion system 22 is shown constructed according to the present invention.

The turbine 10 also includes an intake section 14, a compressor section 16 downstream from the intake section 14, the combustor section 20 being downstream from the intake section 14, a turbine section 18 and an exhaust section 26. The turbine section 18 through a common shaft connection drives the compressor section 16 and a load 28.

The load 28 may be any one of an electrical generator and a mechanical drive application (not shown). Examples of such mechanical drive applications include any one of a compressor for use in oil fields and a compressor for use in refrigeration. When used in oil fields, the application may be gas reinjection service. When used in refrigeration, the application may be in liquid natural gas (LNG) plants. Yet another load 28 may be a propeller as may be found in turbojet engines, turbofan engines and turboprop engines.

The combustor section 20 may include a circular array of a plurality of circumferentially spaced combustors (not shown). A fuel/air mixture is burned in each combustor to produce the hot energetic flow of gas, which flows through a transition piece for flowing the gas to the turbine nozzles of the turbine section 18. A conventional combustor is described in the above-noted U.S. Pat. No. 5,259,184.

During the operation of turbine containing system 10, air is drawn into intake section 14 for compression by compressor section 16 downstream. A portion of the compressed air is delivered to the primary combustion system 22 of combustor section 20 for combination and combustion with fuel in a primary reaction zone of each of the plurality of combustors.

As the primary combustion products move down stream to the secondary combustion system 24, additional fuel and air are introduced through injectors in proportions that permit substantially complete combustion. As in the primary combustion section 22, the combustion temperature and time are controlled to minimize $NO_x$ formation.

The hot products of combustion exiting the secondary combustion system 24 enter the turbine section 18 to the turbine. The turbine of the turbine section 18 through a common shaft connection drives the compressor section 16 and the load 28. It will be appreciated by those skilled in the art that the turbine section 18 may include a plurality of turbines such as, a high-pressure turbine and low-pressure turbine. Likewise, the compressor section 16 may include a plurality of compressors such as, for example, a low-pressure compressor and high-pressure compressor. The hot combustion products upon exiting the turbine section 18 enter the exhaust section 26.

Figure 2:
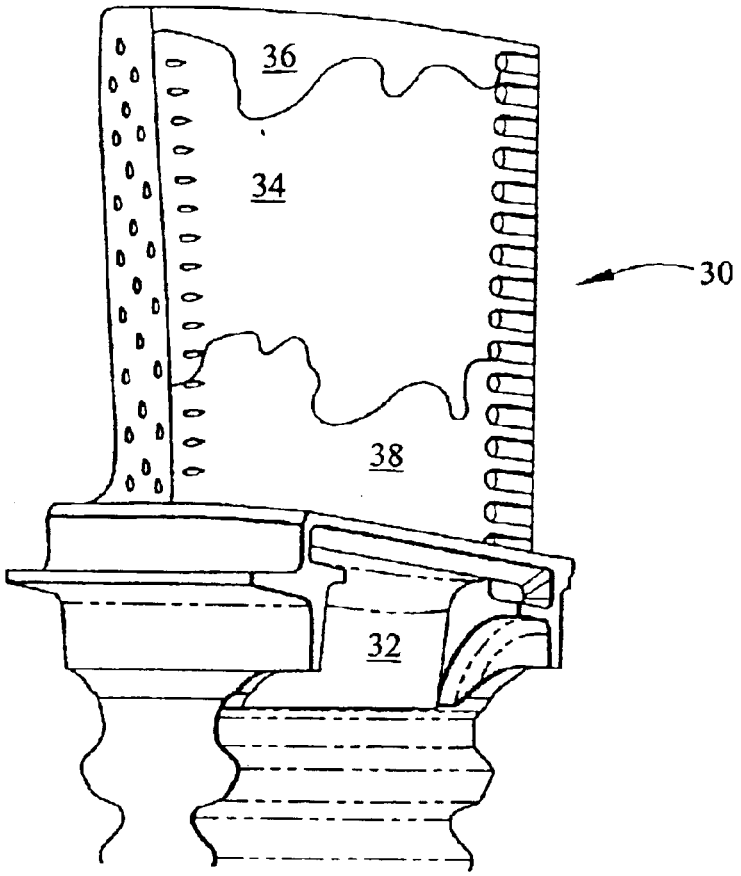
FIG. 2 is a perspective view of the airfoil of the present invention.

As best seen in FIG. 2, an airfoil 30 constructed according to the present invention is shown. Each airfoil 30 includes a root 32 for attaching the airfoil 30 to the hub of a gas turbine vane assembly. In addition, the airfoil 30 includes a center section 34 including a plurality of cooling passages; a distal section 36; and a base section 38 attached to the root 32.

Figure 3:
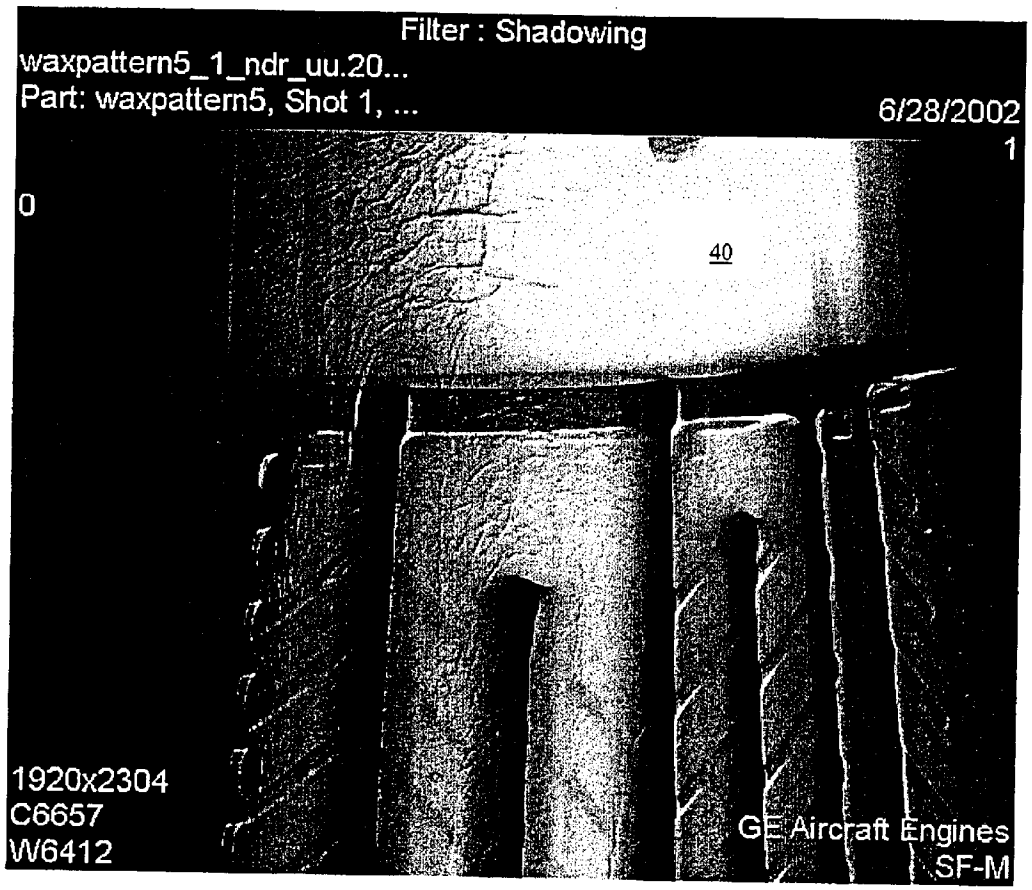
FIG. 3 is an X-Ray view of a prior art airfoil formed using an alcohol-based, gel casting system illustrating the cracked surface of its ceramic preform.

The airfoil 30 is produced generally conventionally by casting shapes formed by injecting slurry into a core die (not shown) to produce a preform 40 (see FIG. 3). The ceramic core (airfoil preform) 40 is cured and removed from the die. After die ejection, the preform 40 is dried and fired. The preform 40 is then embedded in paraffin wax and coated using an alumina-based investment casting mold slurry. Approximately 10 coats are applied to the preform 40. The mold (not shown) is then dried and de-waxed, leaving a mold with the preform 40 centered within the mold-cavity. The airfoil 30 is then cast using a super alloy mixture at high temperature under vacuum. The cast alloy part may include a number of individual airfoils 30 which can then be sectioned and the preform 40 removed mechanically.

FIG. 3 is an X-Ray view of a prior art airfoil formed using an alcohol-based, gel casting system illustrating the cracked surface of its ceramic preform. It has a very cracked surface. It is very visible in the X-ray micrograph of the preform imbedded in the wax.

Turning now to a detailed discussion of the preparation of the ceramic preform 40, as previously discussed water-based, gel casting is a relatively recently developing technique disclosed, for example, in U.S. Pat. Nos. 4,894,194 (issued Jan. 16, 1990); 5,028,362 (issued Jul. 2, 1991); 6,066,279 (issued May 23, 2000); 6,228,229 (issued May 8, 2001); and 6,365,082 (issued Apr. 2, 2002) and Patent Application Publication U.S. 2001/0003576 (published Jun. 14, 2001).

In addition, in the preferred embodiment, a particularly suitable silica-based ceramic powder is taught by Chao et al., entitled *Optimal Composition of Zircon-Fused Silica Ceramic Cores for Casting Superalloys, J. Am. Ceram. Soc.,* 85 [4] 773–79 (2002). The disclosures of each of these references are hereby incorporated by reference in their entirety.

The present invention may be further understood by a reading of the following example.

EXAMPLE

A monomer system was prepared consisting of methacrylamide (MAM), N-vinyl pyrrollidone (NVP), and poly (ethylene glycol 1000)-dimethacrylate (PEG(1000)DMA) dissolved in water. The monomer-containing aqueous solution consisted of 30 wt. % monomer in a 3:3:2 (by weight) ratio of MAM, NVP, and PEG(1000)DMA, respectively. The ceramic loading of the slurry was 61 vol. %, formulated using a silica-zircon blend consisting of 37.8 weight % zircon, 60 weight % coarse fused silica, and 2.2 weight % fumed silica as taught by Chao et. al., which is herein incorporated by reference.

The dispersion of the ceramic particles in suspension was accomplished by maintaining the pH of the solution between 10.5 and 11.5 using tetramethyl ammonium hydroxide (TMAH). The powder was added incrementally to avoid clumping, and was mixed using a Waring high-shear laboratory mixer. The mixing cup was chilled with ice during mixing to avoid evaporation of the solution due to heating. Suspensions were de-aired in a Whip Mix rotary vacuum mixer prior to casting.

Core shapes were cast using chrome-plated steel dies coated with Frekote 770-NC die release. The dies were heated to 50° C. prior to casting. The slurry was injected into the die using polyethylene syringes.

The ceramic cores were cured at 50° C. for 30 minutes prior to die removal. After die ejection, the parts were frozen immediately, then freeze-dried to eliminate warping.

The dried specimens were fired at 1100° C. for 1 hour. The cores were then embedded in paraffin wax and coated using an alumina-based investment casting mold slurry. Approximately 10 coats were applied to the part. The mold was then dried and de-waxed at 200° C., leaving a mold with the core centered within the mold-cavity.

The alloy part was cast at 1550° C. under vacuum. The alloy part was then sectioned, and the core was removed mechanically.

Figure 4:
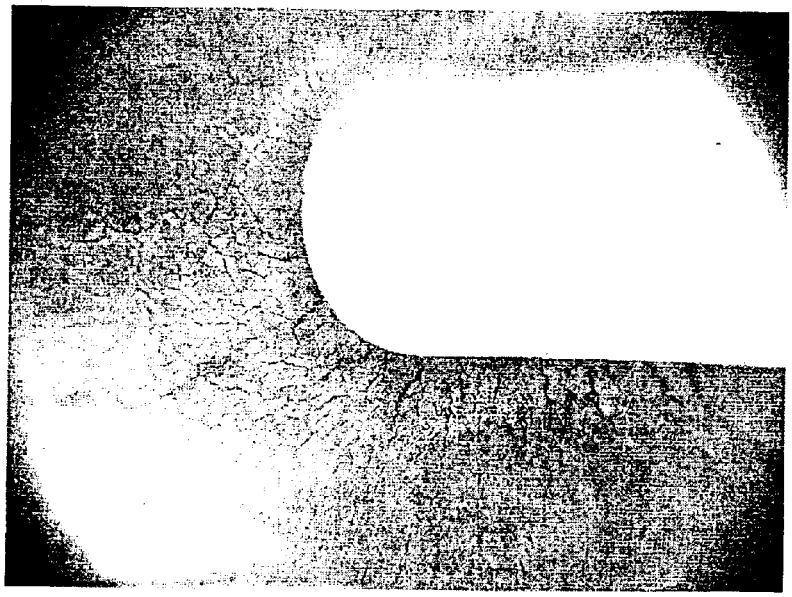
FIGS. 4A and 4B are a comparison between conventional, alcohol-based core typically used in current gas-turbine castings illustrating its crazed surface the improved core prepared using gel-casting, according to the present invention, illustrating its improved surface finish.
Figure 4:
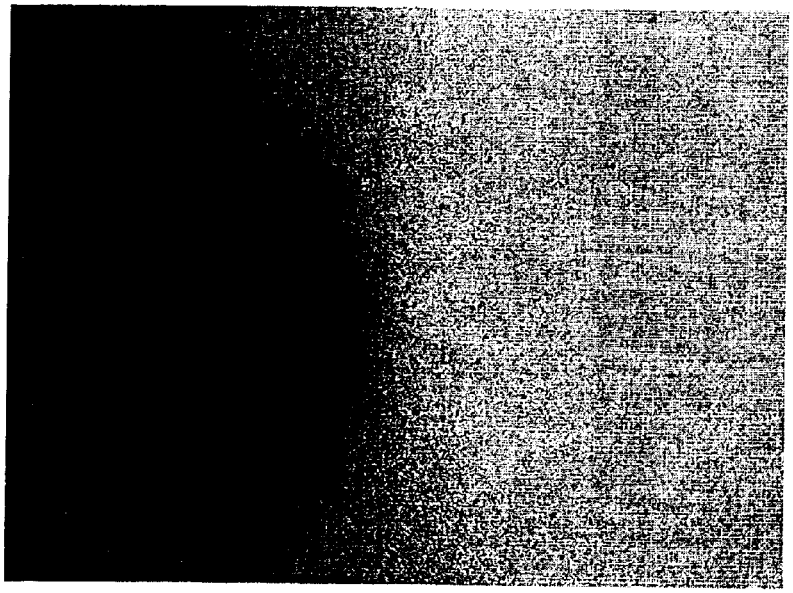

The advantages of the present invention can first be appreciated by referring to FIGS. 4A and 4B. FIG. 4A is a conventionally formed, alcohol-based, gel casing that is dried and then ignited to burn off the excessive alcohol. As can be seen, the cooling passages within the airfoil 30 are cracked and crazed. For comparison, FIG. 4B is a water-based, gel casing formed according to the present invention which is freeze-dried to remove the excessive water. As can be seen, the cooling passages within the airfoil 30 are substantially craze-free.

As discussed earlier, a water-based, gel castings sets up quickly like an alcohol-based, gel casting but, because the preform 30 can be freeze-dried rather than burned off, it can be dried without cracking. Thus, a water-based, a gel casting does not necessarily dry quicker but it can be dried without cracking.

Also, for example, one problem with prior art slip cast-type systems is a much longer time to set up and not very good on dimensional tolerance. Gel casting also allows about 40 vol. % water that is close to the 50–55 vol. % water achieved by slip casting. However, in slip casting, the drying rate is defined by the way the powder consolidates because the water is removed from the slurry somewhat like a coffee filter. Specifically, the powder may form a dense cake over the top of the filter thereby making it much harder for the water to percolate through the cake. Thus, slip casters intentionally try to form partially coagulated slurries that have very high porosity that allows the water to pass through more easily. As a result, the eventual part density of the ceramic is lower in a slip cast part than it would be in a part formed by gel casting.

These competing interests may be better understood from the following Table which compares set-up time; eventual part density; and cracking on a 1–5 scale for the prior art and the present invention. The overall score is the product of the three factors.

TABLE

| Casting System | Set-up Time | Part Density | Cracking | Overall Score |
|---|---|---|---|---|
| Alcohol-based Gel casting | 4 | 4 | 2 | 32 |
| Water-based Slip casting | 2 | 2 | 4 | 16 |
| Water-based Gel casting | 4 | 4 | 4 | 64 |

Figure 5:
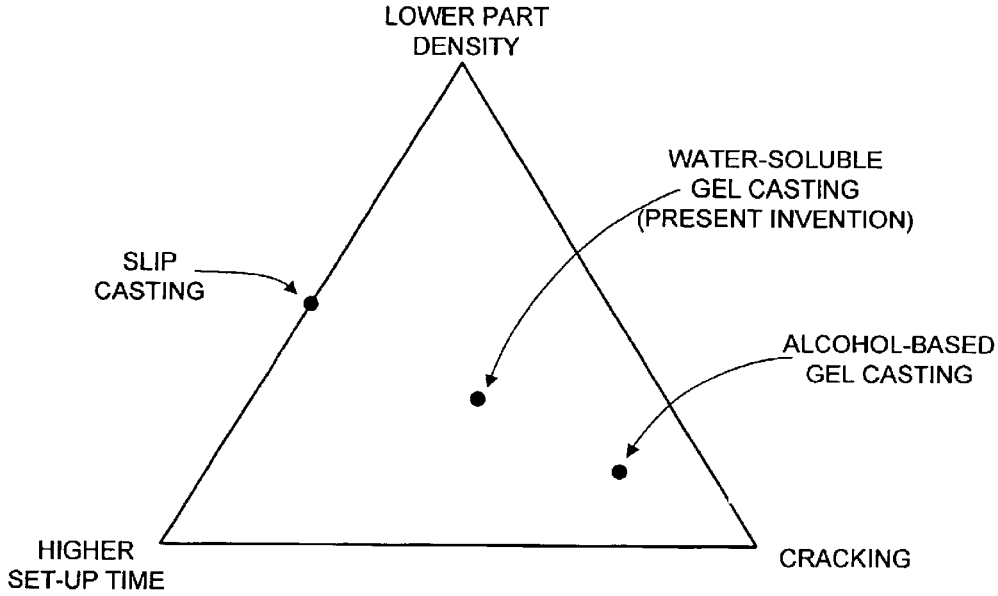
FIG. 5 is a graphical representation of the competing effects of set-up time, part density and cracking.

The advantages of water-based, gel casing can further be seen in FIG. 5, which is a graphical representation of the competing effects of set-up time, part density and cracking. As can be seen, conventional slip casting has little cracking but has both higher set-up time and lower part density. Likewise, conventional alcohol-based, gel casting has good set-up times and part densities but cracks. To the contrary, water-based, gel casting has above average set-up time and part density while, at the same time, is substantially craze-free.

Certain modifications and improvements will occur to those skilled in the art upon a reading of the foregoing description. It should be understood that all such modifications and improvement have been deleted herein for the sake of conciseness and readability but are properly within the scope of the following claims.

What is claimed is:

1. A ceramic preform for forming an airfoil having a plurality of craze-free cooling passages, said preform comprising:

(a) ceramic powder;

(b) a water-based, gel forming precursor; and (c) a dispersant for dispersing said ceramic powder, wherein said dispersant is tetra-methyl ammonium hydroxide.

2. The apparatus according to claim 1, wherein said ceramic powder is a silica-based ceramic.

3. The apparatus according to claim 2, wherein said silica-based ceramic is a silica zirconium ceramic having a particle size distribution between about 0.5 and 25 microns.

4. The apparatus according to claim 1, wherein said water-based, gel forming precursor is a monomer solution including at least one water-based, monofunctional monomer and at least one water-based, difunctional monomer, the functional group of said monofunctional and difunctional monomer selected from vinyl and allyl groups, a free radical initiator compound and an aqueous solvent.

5. The apparatus according to claim 1, wherein the pH of said dispersant for dispersing said ceramic powder is adjusted to between 10.5 and 11.5.

6. An airfoil for an internal combustion engine, such as a gas turbine, formed by use of a preform, said airfoil comprising:

(a) an outer surface forming the foil shape;

(b) a plurality of craze-free cooling passages extending through said airfoil, said craze-free cooling passages being formed by use of a ceramic preform for forming said airfoil, said preform including: (i) ceramic powder; (ii) a water-based gel forming precursor; and (iii) a dispersant for dispersing said ceramic powder, wherein said dispersant is tetramethyl ammonium hydroxide; and (c) a root for joining said airfoil to the hub of a gas turbine vane assembly, wherein said gas turbine vane assembly is adapted to receive replaceable airfoils.

7. The apparatus according to claim 6, wherein said gas turbine vane assembly is a rotating assembly.

8. The apparatus according to claim 7, wherein said rotating assembly is attached to the shaft of a gas turbine.

9. The apparatus according to claim 6, wherein said gas turbine vane assembly is a stationary assembly.

10. The apparatus according to claim 9, wherein said stationary assembly is attached to the shell of a gas turbine.

11. The apparatus according to claim 6, wherein said ceramic powder is a silica-based ceramic.

12. The apparatus according to claim 11, wherein said silica-based ceramic is a silica zirconium ceramic having a particle size-distribution-between about 0.5 and 25 microns.

13. The apparatus according to claim 6, wherein said water-based, gel forming precursor is a monomer solution including at least one water-based, monomer and at least one water-based, difunctional monomer, the functional group of said monofunctional and difunctional monomer selected from vinyl and allyl groups, a free initiator compound and an aqueous solvent.

14. The apparatus according to claim 6, wherein the pH of said dispersant for dispersing said ceramic powder is adjusted to between 10.5 and 11.5.

* * * * *